United States Patent [19]

Bald et al.

[11] Patent Number: 4,674,313

[45] Date of Patent: Jun. 23, 1987

[54] HIGH- AND LOW-FORCE ADJUSTABLE ROLL STAND

[75] Inventors: Wilfried Bald; Klaus Klamma, both of Hilchenbach, Fed. Rep. of Germany

[73] Assignee: SMS Schloemann-Siemag AG, Dusseldorf, Fed. Rep. of Germany

[21] Appl. No.: 717,508

[22] Filed: Mar. 29, 1985

[30] Foreign Application Priority Data

Mar. 30, 1984 [DE] Fed. Rep. of Germany ..... 3411853

[51] Int. Cl.[4] ..... B21B 35/06

[52] U.S. Cl. ..... 72/249; 72/245; 72/442; 72/444; 74/665 L

[58] Field of Search ..... 72/241, 249, 442, 444, 72/245; 74/665 L, 665 N, 661

[56] References Cited

U.S. PATENT DOCUMENTS 4,478,064 10/1984 Brenneman ..... 72/245

FOREIGN PATENT DOCUMENTS 3038865 12/1982 Fed. Rep. of Germany .

160814 12/1981 Japan ..... 72/249

*Primary Examiner*—Robert L. Spruill

*Assistant Examiner*—Steve Katz

*Attorney, Agent, or Firm*—Karl F. Ross; Herbert Dubno

[57] ABSTRACT

A roll stand has a frame, an upper backup roll and a lower backup roll rotatable in the frame about respective vertically spaced axes, and an upper working roll and a lower working roll flanked by and operatively engaging the respective backup rolls. A workpiece normally passes horizontally through the nip formed by the working rolls. Actuators can urge the backup rolls toward each other with a high force and with a low force. Respective upper and lower drives are connected to the respective backup rolls and energizable for rotating same and thereby pulling the workpiece engaged between the working rolls through the roll stand. A clutch is connected between one of the drives and the respective backup roll and is openable to rotationally disconnect the one drive from its backup roll. A controller is connected to the one drive and the clutch for deenergizing the one drive and opening the clutch for low-force rolling. For high-force rolling the clutch is closed and both drives are energized.

6 Claims, 2 Drawing Figures

HIGH- AND LOW-FORCE ADJUSTABLE ROLL STAND

FIELD OF THE INVENTION

The present invention relates to a four- or six-high roll stand and to a method operating same. More particularly this invention concerns such a stand used in the size-reduction rolling or burnish-finishing of metal strip.

BACKGROUND OF THE INVENTION

A standard four-high roll stand comprises a frame, an upper backup roll and a lower backup roll rotatable in the frame about respective vertically spaced axes, and an upper working roll and a lower working roll flanked by and operatively engaging the respective backup rolls. Actuators urge the backup rolls toward each other and respective upper and lower drives are connected to the respective backup rolls to rotate same and thereby pull a workpiece engaged between the working rolls through the roll stand. An inner backup roll may be provided in a six-high arrangement between each of the outer backup rolls and the respective working roll. The rolls may be cylindrical or even bottle-shaped (See German patent No. 3,038,865 and U.S. patent application No. 311,449 (now U.S. Pat. No. 4,440,012) filed Oct. 14, 1981), and can be relatively axially shiftable.

For the size reduction of the workpiece the outer backup rolls are urged toward each other with a high force and both of the drives apply considerable torque to these backup rolls. The force is transmitted frictionally to the working rolls which in turn engage and pull the workpiece. The drives are rated such that they operate at high efficiency in this high-force mode.

For various roll-type finishing operations the squeeze force applied to the workpiece is substantially less, as no appreciable thickness reduction is wanted. In such operation the frictional coupling between the backup rolls and the respective working rolls, as well as between the workpiece and the working rolls, is substantially reduced. The drives must therefore be operated to deliver a fairly low torque to the backup rolls, in a range in which the respective motors normally are very inefficient. Thus when such a roll stand is applied to a light-force application it operates inefficiently.

In addition in the low-force mode, which can be only one-tenth the force of the high-force mode, there is a tendency of the system to vibrate. This has been traced in part to small variations in the drive speeds of the two backup rolls, variations which are impossible to eliminate completely. Such problems are aggravated even more in arrangements wherein the plane of the working-roll axes is offset parallel to the workpiece-travel direction from that of the backup rolls, as suggested in application Ser. No. 710,837, filed Mar. 12, 1985.

OBJECTS OF THE INVENTION

It is therefore an object of the present invention to provide an improved four- or six-high roll stand.

Another object is the provision of such a four- or six-high roll stand which overcomes the above-given disadvantages, that is which is efficient whether operating at high or low force.

SUMMARY OF THE INVENTION

A roll stand according to this invention has a frame, an upper backup roll and a lower backup roll rotatable in the frame about respective vertically spaced axes, and an upper working roll and a lower working roll flanked by and operatively engaging the respective backup rolls. A workpiece normally passes horizontally through the nip formed by the working rolls. Actuators can urge the backup rolls toward each other with a high force and with a low force. Respective upper and lower drives are connected to the respective backup rolls and energizable for rotating same and thereby pulling the workpiece engaged between the working rolls through the roll stand. A clutch is connected between one of the drives and the respective backup roll and is openable to rotationally disconnect same. A controller is connected to the one drive and the clutch for deenergizing the one drive and opening the clutch for low-force rolling.

According to a further feature of this invention a synchronizing transmission is connected between the working rolls for synchronous rotation thereof and a second clutch is connected between the synchronizing transmission and one of the working rolls and is openable to rotationally disconnect same from the other working roll. The controller is connected to the second clutch to close same when the first-mentioned clutch is opened.

Thus the instant invention is also a method of operation a roll stand. In a low-force mode one of the drives is disconnected from the respective backup roll and the one drive is deenergized so that torque is transmitted from the backup roll of the one drive to the respective working roll and thence to the other working roll. In a high-force mode both of the backup rolls are driven by means of the respective drives so that both of the working rolls are driven frictionally off the respective backup rolls. In addition in the low-force mode the working rolls can be coupled together, by means of the above-mentioned transmission for synchronous rotation.

With the arrangement of this present invention, therefore, in the low force mode one of the drive motors does all the work. It is therefore able to operate in its most efficient range while the other motor is shut down together. The synchronizing transmission prevents slip between the working rolls and the workpiece as the radial force between the rolls and workpiece is too small often to transmit the necessary angular force.

DESCRIPTION OF THE DRAWING

The above and other features and advantages will become more readily apparent from the following, reference being made to the accompanying drawing in which.

SPECIFIC DESCRIPTION

Figure 1:
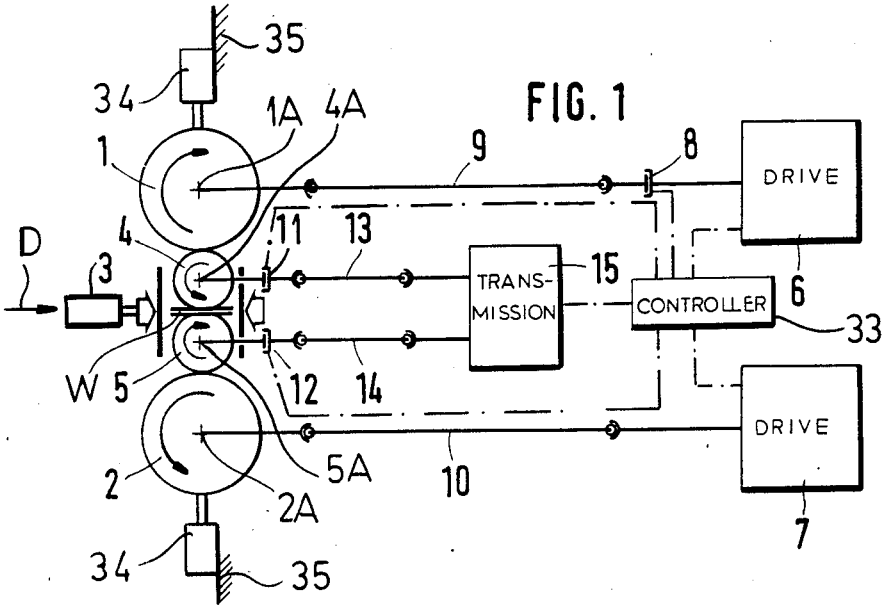
FIGS. 1 and 2 are diagrammatic end views of four- and six-high roll stands according to this invention.

As seen in FIG. 1 a four-high roll stand according to the invention has upper and lower backup rolls 1 and 2 rotatable about respective parallel upper and lower axes 1A and 2A and vertically flanking smaller-diameter working rolls 4 and 5 rotatable about respective parallel and horizontal axes 4A and 5A at least generally coplanar with the axes 1A and 2A. A horizontal shifting device shown diagrammatically at 3 can move the rolls 4 and 5 in and against the travel direction D of a workpiece W pinched between the rolls 4 and 5. In addition the rolls 1 and 2 can be urged vertically toward each other by actuators 34 carried on the frame 35 in which the rolls 1, 2, 4, and 5 are journaled.

Motor-transmission drives 6 and 7 are connected via respective shaft assemblies 9 and 10 to the rolls 1 and 2. These shaft assemblies 9 and 10 allow some offset between each drive 6 or 7 and the respective roll 1, 2, so that each such assembly, for instance, comprises a stub shaft on the respective drive, a first universal joint having one end connected to the stub shaft and an opposite side connected to one end of a telescoping splined shaft whose other end is connected via another universal joint to the stub shaft of the respective roll. The shaft assembly 9 of the upper roll 1 is provided with a clutch 8 which can be of the simple jaw type.

Further such shaft assemblies 13 and 14 are connected to the two sides of a 1:1 synchronizing transmission 15 which can be a single large-diameter gear urged into mesh with two smaller-diameter pinions carried by the shafts 13 and 14 of the working rolls 4 and 5. The shaft assemblies 13 and 14 are also provided with torque-transmitting jaw-type clutches 11 and 12.

For high-force rolling, such as for instance in the size reduction of strip, a controller 33 causes both of the drives 6, 7 to operate at the same synchronous speed, closes the clutch 8, and opens the clutches 11 and 12, while of course pressurizing the actuators 34 to exert the desired high force toward the workpiece-gripping nip. Thus the backup rolls 1 and 2 frictionally drive the working rolls 4 and 5 which in turn grip the workpiece W and pull it through the stand. The drives 6 and 7 are of such power rating that in this mode they are each delivering substantial torque, well within their most efficient operating ranges.

For low-force rolling, such as for instance in the burnishing or polishing of strip stock with minimal size reduction, the controller 33 opens the clutch 8 and shuts down the drive 6. The clutches 11 and 12 are closed to synchronize rotation of the rolls 4 and 5, and the whole system is powered only by the drive 7. The torque produced by this drive 7 therefore is applied to the whole system, so that once again this drive is operated in its efficient range. The possibility of slippage between the workpiece W and the rolls 4 and 5 is eliminated by the extra torque transmitted from the roll 5 via the transmission 15 to the roll 4, and the roll 1 is driven wholly as an idler by the roll 4.

Figure 2:
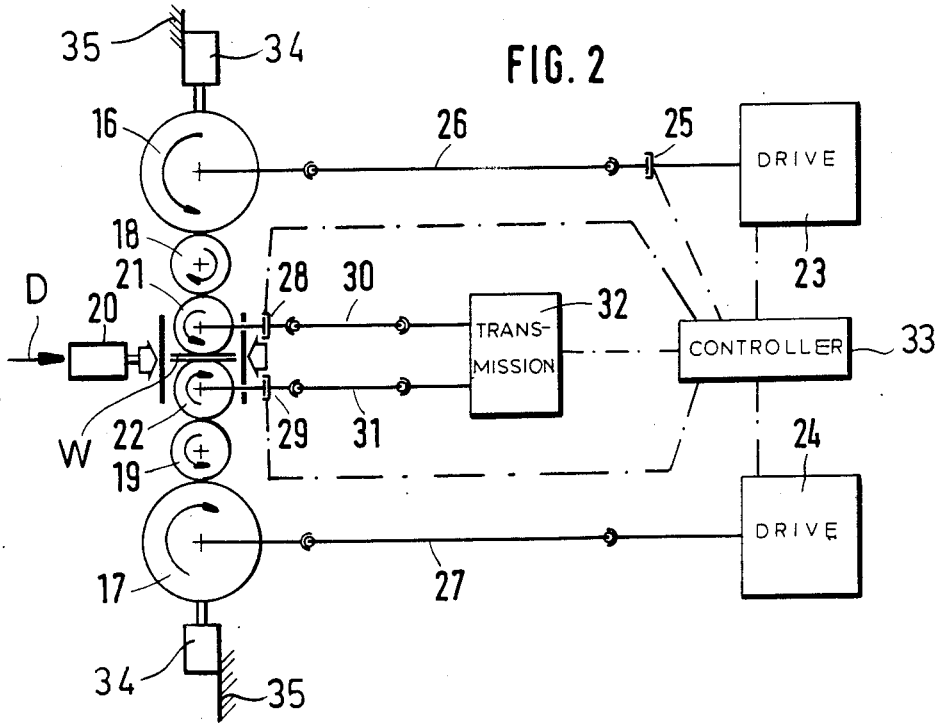

FIG. 2 shows a six-high roll stand having upper and lower backup rolls 16 and 17 rotatable about respective parallel upper and lower axes and vertically flanking upper and lower inner backup rolls 18 and 19 in turn flanking smaller-diameter working rolls 21 and 22. A horizontal shifting device shown diagrammatically at 20 can move the rolls 21 and 22 in and against the travel direction D of the workpiece W pinched between the rolls 21 and 22.

Motor-transmission drives 23 and 24 are connected via respective shaft assemblies 26 and 27 to the rolls 16 and 17. The shaft assembly 26 of the upper outer backup roll 16 is provided with a clutch 25. Further such shaft assemblies 30 and 31 are connected to the two sides of a synchronizing transmission 32. The shaft assemblies 30 and 31 are also provided with torque-transmitting jaw-type clutches 28 and 29.

This arrangement works substantially identically to that of FIG. 1, except that rotation is transmitted via the inner backup rolls 18 and 19 between the respective outer backup rolls 16 and 17 and working rolls 21 and 22. When the outer backup rolls 16 and 17 are urged toward each other by the actuators 34 with a high force the clutches 28 and 29 are open, the clutch 25 is closed, and both drives 23 and 24 power the respective rolls 16 and 17, and therethrough the respective rolls 21 and 22. When a lighter force is being used, the clutch 25 is opened and its drive 23 turned off, the clutches 28 and 29 are closed, and the entire arrangement is powered from the drive 24.

The arrangement of this invention can therefore be adapted to different types of rolling operations, and will operate efficiently in any mode. Thus the mill equipped with such an arrangement can do different jobs with the same roll stand. Such versatility of application is extremely valuable for such expensive equipment as rolling equipment.

We claim:

1. A roll stand comprising:

a frame;

an upper working roll and a lower working roll rotatable in said frame about respective vertically spaced axes and defining a nip through which a workpiece can be passed;

upper backup means including at least one upper backup roll rotatable in said stand and braced vertically against said upper working roll, and lower backup means including at least one lower backup roll rotatable in said stand and braced vertically against said lower working roll;

respective drives operatively connected with said upper and lower backup means for rotating said upper and lower backup rolls, including respective motors each connected to one of said drives;

a synchronizing transmission connected between said working rolls for synchronous rotation thereof; and at least one clutch connected between said synchronizing transmission and one of said working rolls and provided with control means openable selectively for rotationally disconnecting said synchronizing transmission from the said one of said working rolls.

2. The roll stand defined in claim 1, further comprising:

actuator means on said stand and operatively connected to said upper and lower backup means for selectively urging the backup rolls toward each other with a high force and with a low force;

a second clutch connected between one of said drives and the respective backup roll and openable to rotationally disconnect said one of said drives from the respective backup roll; and control means connected to said one of said drives and said second clutch for deenergizing said one of said drives and opening said second clutch for low-force rolling.

3. The roll stand defined in claim 2 wherein said control means is connected to the first-mentioned clutch to close said first-mentioned clutch when said second clutch is opened.

4. The roll stand defined in claim 1, claim 2 or claim 3 for a six-high roll arrangement wherein each of said backup means includes a respective backup roll and an intermediate roll between the respective backup roll and the respective working roll.

5. A method of operating a roll stand comprising:

a frame;

an upper backup roll and a lower backup roll rotatable in the frame about respective vertically spaced axes;

an upper working roll and a lower working roll flanked by and operatively engaging the respective backup rolls, a workpiece normally passing horizontally through a nip formed by the working rolls;

actuator means for urging the backup rolls toward each other with a high force and with a low force; and respective upper and lower drive means connected to the respective backup rolls and energizable for rotating same and thereby pulling a workpiece engaged between the working rolls through the roll stand;

the method comprising the steps of:

in a low-force mode disconnecting one of the drive means from the respective backup roll; and deenergizing the one drive means, whereby torque is transmitted from the backup roll of the one drive means to the respective working roll and thence to the other working roll; and in high-force mode driving both of the backup rolls by means of the respective drive means and thereby driving both of the working rolls frictionally off the respective backup rolls.

6. The method defined in claim 5, further comprising the step of:

in the low-force mode rotationally coupling the working rolls together by means other than the workpiece for synchronous rotation of same.

* * * * *